US005911764A

United States Patent [19]

Wei Kong

[11] Patent Number: 5,911,764

[45] Date of Patent: Jun. 15, 1999

[54] BOTTLE LOCK WITH A CHUCK DEVICE

[76] Inventor: Yu Wei Kong, 6288 Pride La., Las Vegas, Nev. 89103

[21] Appl. No.: 08/901,119

[22] Filed: Jul. 28, 1997

[51] Int. Cl.[6] ..... B65D 55/14

[52] U.S. Cl. ..... 70/160; 70/164; 70/167; 215/204; 215/277; 220/210; 220/259; 220/315; 292/43; 292/155

[58] Field of Search ..... 70/158–173; 292/155, 292/43; 215/204, 207, 208, 228, 277, 278; 220/210, 256, 259, 315

[56] References Cited

U.S. PATENT DOCUMENTS

| | | | |
|---|---|---|---|
| 150,299 | 4/1874 | De Gress | 215/207 |
| 614,732 | 11/1898 | Leseman et al. | 70/168 |
| 997,088 | 7/1911 | Prager | 70/168 |
| 1,605,075 | 11/1926 | Shaff | 220/256 |
| 1,791,277 | 2/1931 | Lake | 215/277 X |
| 2,082,921 | 6/1937 | Vetorino | 220/315 X |
| 2,124,035 | 7/1938 | Hurd | 70/169 |
| 2,675,229 | 4/1954 | Anderson | 292/43 X |
| 5,515,634 | 5/1996 | Kong | 70/171 X |

FOREIGN PATENT DOCUMENTS

| | | | |
|---|---|---|---|
| 134623 | 11/1947 | Australia | 70/165 |
| 2417713 | 10/1975 | Germany | 220/210 |

*Primary Examiner*—Lloyd A. Gall
*Attorney, Agent, or Firm*—Quirk & Tratos

[57] ABSTRACT

An open ended cylindrical chuck device has an inner fixing ring, an outer movable turning ring, and three movable screw threaded bars crossing the chuck device. While the turning ring is turned, the screw threads on the turning ring move three screw threaded bars to hold a bottle to be locked. A fixing pin crosses two holes which located separately on fixing ring and turning ring to stop their movement. A cylindrical cap with a regular lock locks the chuck device. Thus the bottle is locked.

8 Claims, 6 Drawing Sheets

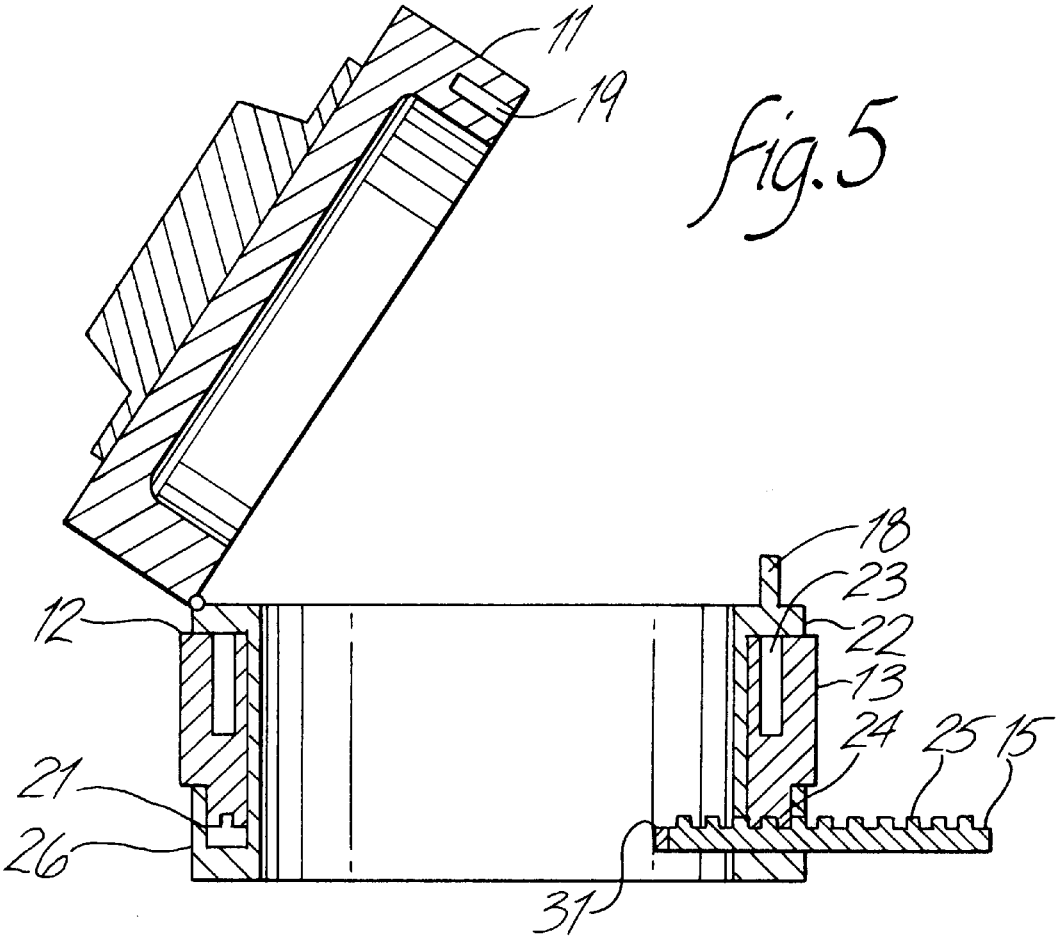
Fig. 5
Fig. 6
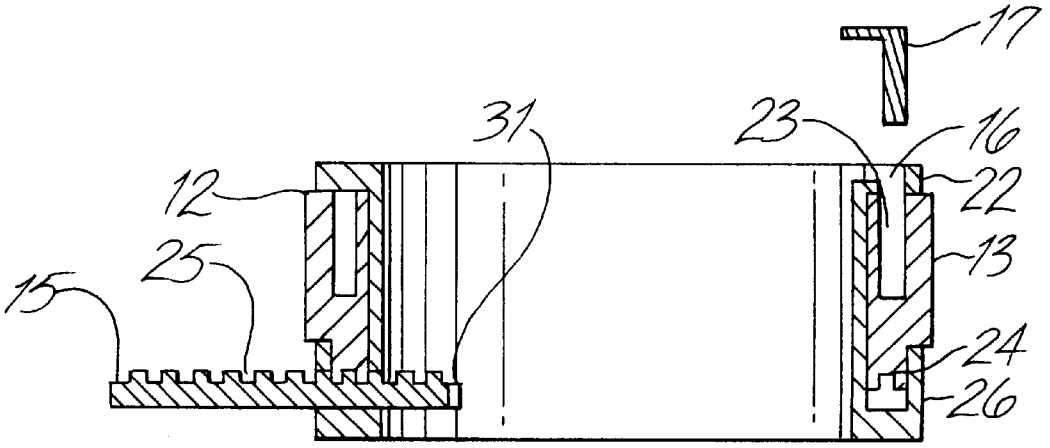

BOTTLE LOCK WITH A CHUCK DEVICE

BACKGROUND OF THE INVENTION

1. Field of the Invention

This invention relates to a lock device which can easily lock any bottle to prevent unauthorized children and adults from using it.

2. Description of the Prior Art

Intending to lock any bottle to prevent unauthorized persons from using it, my prior invention Household Safety Lock, U.S. Pat. No. 5,515,634 disclosed a bottle lock device. It includes an open ended cylindrical connecting part with screw threads and a ditch on its interior surface, another connecting part casted to the bottle with same screw threads and a ditch on its exterior surface, a fixing pin for preventing movement of both connecting parts when they are engaged, and a cylinder cap with a regular lock. This lock device can lock many items not only bottle. But each item needs to be casted or added a screw threads connecting part on it. So its usage is limited. The instant invention discloses a bottle lock device on the same principle but using a chuck device instead of the screw threads connecting parts. Any locked bottle no longer needs to be casted or added a screw threads connecting part. The problem is solved.

Industrial chuck device and keyless chuck device of the electric drills are well-known, for quick and easy bit changes. An outer movable turning ring with screw threads on its interior surface makes three movable screw threaded bars forward to hold the bit, or backward to slip the bit. There is not any lock device in chuck device to stop turning of the outer movable turning ring. So its usage is limited. The instant invention discloses a device to stop turning of the outer movable turning ring of chuck device. There are two groups of holes located separately on outer turning ring and inner fixing ring. Two holes of different groups may form a joint ditch. A fixing pin will cross the joint ditch to prevent any movement of outer movable turning ring. Although the instant invention still uses a chuck device to hold the bottle, the chuck device is not the same one of the prior art.

SUMMARY OF THE INVENTION

According to the present invention, Bottle Lock With A Chuck Device includes a regular lock with a cylindrical cap, an open ended cylindrical chuck part having an inner fixing ring, an outer movable turning ring, and three movable screw threaded bars crossing the cylindrical chuck part. There are screw threads on the movable turning ring to move three movable screw threaded bars forward or backward together. There are two groups of holes separately located on the fixing ring and the movable turning ring. A fixing pin can cross two holes located separately on both rings for preventing their movement. Thus the chuck part is easily fixed to a bottle, and the cylindrical cap with regular lock will lock it.

BRIEF DESCRIPTION OF THE INVENTION

The drawings appended hereto are as follows:

FIG. 5 is a vertical cross-sectional view of FIG. 2 taken along the line 5—5;

FIG. 6 is a vertical cross-sectional view of FIG. 2 taken along the line 6—6;

DETAILED DESCRIPTION OF THE PREFERRED EMBODIMENTS

Figure 1:
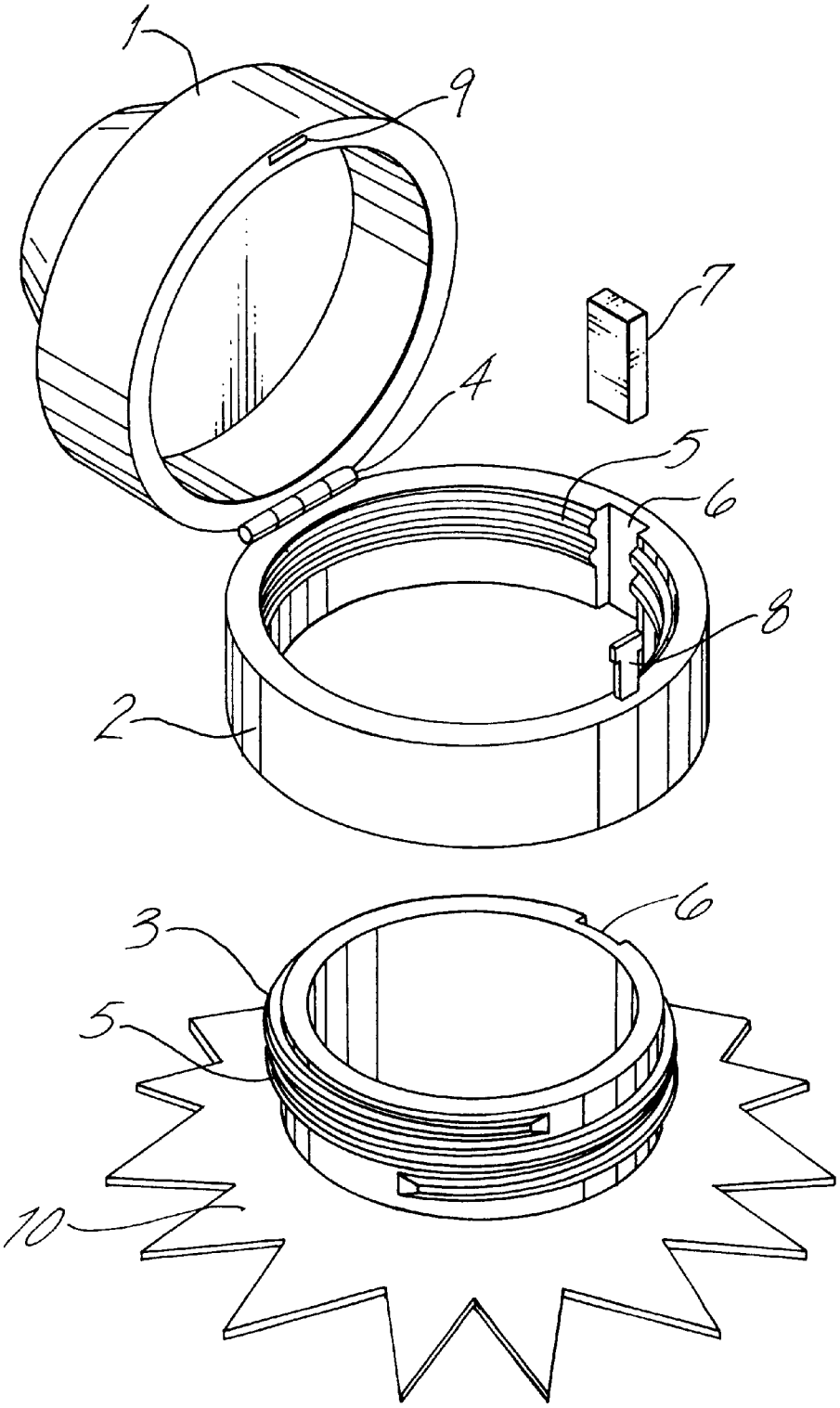
Fig. 1 PRIOR ART
FIG. 1 is a perspective view showing a prior art bottle lock device which is invented by me.

FIG. 1 is a perspective view showing a prior art bottle lock device which is invented by me. It includes a cylindrical cap 1 containing a convenient, lock well known in the art, a connecting part 2 having the shape of a hollow, open ended cylinder and a bar 7. The interior surface of connecting part 2 has screw threads 5 and a longitudinal ditch 6. Connecting part 2 connects to cap 1 with hinge 4. Locking rod 8 on connecting part 2 can be pushed into a hole 9 on cap 1, whereby the lock disposed in the cap 1 proximate to the hole 9 engages the rod 8 to secure the cap 1 to the connecting part 2. There is a connecting part 3 on the bottle 10 (Bottle 10 is partially cut away the figure). There are same screw threads 5 and same ditch 6 on the exterior surface of connecting part 3. Turning both screw threads 5 to put connecting part 3 into connecting part 2, finally let both ditches 6 turn onto the same point, then push pin 7 into ditches 6, thus the lock device 1 & 2 is fixed to bottle 10. We can lock or unlock it easily. We can remove the lock still easily when we pull out pin 7.

Although it is same style, the manner in which connecting part 2 being fixed to bottle 10 by turning both screw threads 5 to put connecting part 3 into connecting part 2, is not construed to form a part of the present invention.

Figure 2:
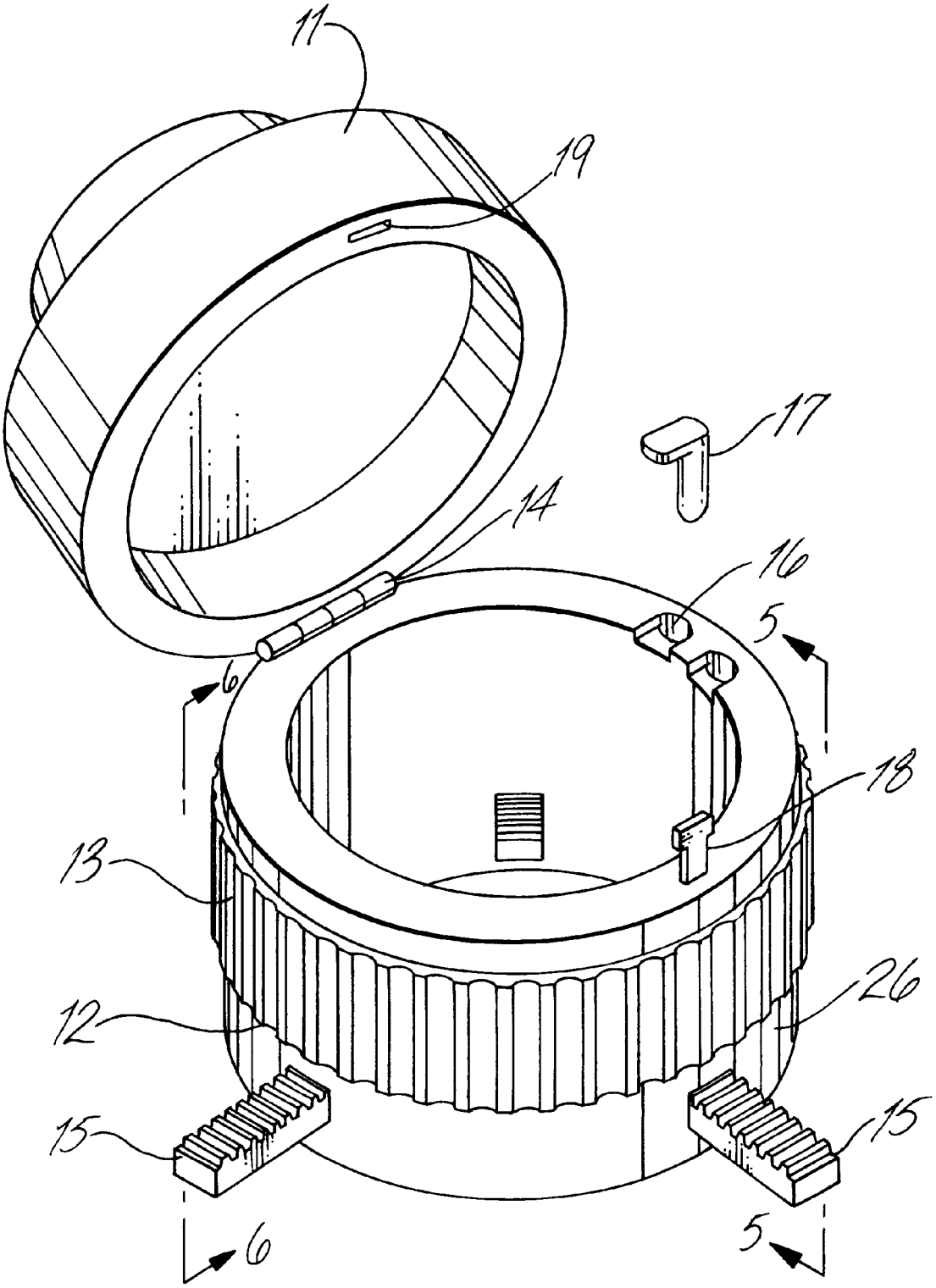
FIG. 2 is a perspective view of Bottle Lock With A Chuck Device.

The preferred embodiment of the present invention is described as followings:

FIG. 2 is a perspective view of Bottle Lock With A Chuck Device. It includes a cylindrical cap 11 with a regular lock, a chuck part 12 having the shape of a hollow, open ended cylinder and a pin 17. The chuck part 12 is formed with an inner fixing ring 26, an outer movable turning ring 13, and three movable screw threaded bars 15 crossing fixing ring 26. Turning ring 13 is hooped to fixing ring 26, and can be turned by hand. It moves three bars 15 forward or backward together. There are a group of longitudinal holes 16 on fixing ring 26 for pin 17 pushing in, to stop the movement of turning ring 13. Chuck part 12 connects to cap 11 with hinge 14. A locking rod 18 on chuck part 12 can be pushed into hole 19 on cap 11, thus whereby the lock disposed in cap 11 proximate to the hole 19 engages the rod 18 to thereby lock chuck part 12 to cap 11.

Figure 3:
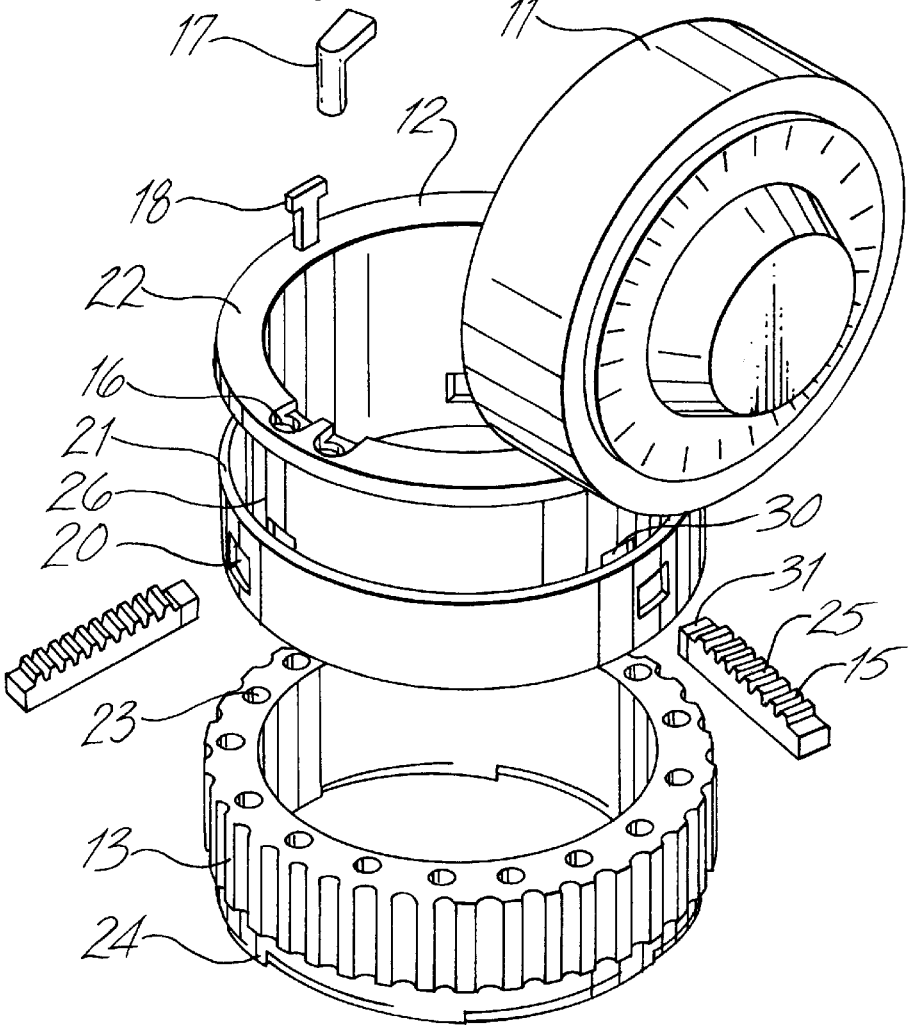
FIG. 3 is a perspective view in another direction of Bottle Lock With A Chuck Device, in which the movable turning ring and the movable screw threaded bars are separated with the fixing ring.

FIG. 3 is a perspective view in another direction of Bottle Lock With A Chuck Device, in which the movable turning ring and the movable screw threaded bars are separated with the fixing ring 26. Turning ring 13 is a hollow, open ended cylinder with screw threads 24 on its bottom surface, with a group of longitudinal holes 23 on its top surface, and with striations for gripping its exterior surface. Fixing ring 26 is a hollow, open ended cylinder with two round walls 21 & 22 separately connecting to the ends of its exterior surface. Turning ring 13 is received between walls 21 and 22 to encircle fixing ring 26. Walls 21 & 22 guide the turning ring 13 as it is turned and retain the turning ring 13 around the fixing ring 26. There are three holes 20 on wall 21 aligned with three holes 30 on wall 22 such that each of the three bars 15 pass through, and are retained in, both sets of holes 20 and 30 simultaneously. There are screw threads 25 on each bar 15. They engage with screw threads 24 of turning ring 13. Bars 15 will move forward or backward together when we turn turning ring 13. There is a rubber end 31 fixed to the inner end of each bar 15. Rubber ends 31 or spring ends will hold bottles easily. There are a group of open ended holes 16 on wall 22. One of holes 16 and one of holes 23 will form a joint hole for pin 17 pushing in, to prevent the movement of turning ring 13.

Figure 4:
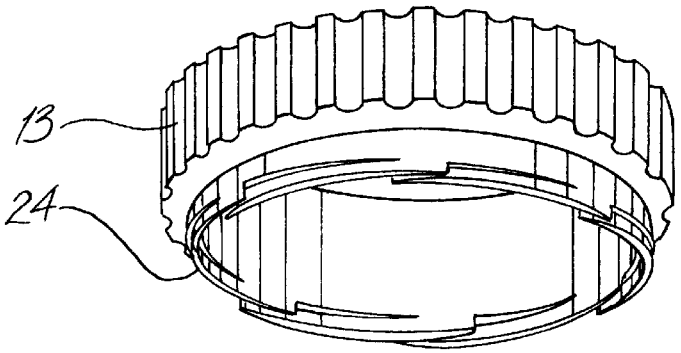
FIG. 4 is a perspective view of the movable turning ring, showing its bottom surface shown in FIG. 3.

FIG. 4 is a perspective view of the movable turning ring, showing its bottom surface shown in FIG. 3. There are screw threads 24 on the bottom surface of turning ring 13. They engage with screw threads 25 of bars 15 to move bars 15.

FIG. 5 is a vertical cross-sectional view of FIG. 2 taken along the line 5—5. When we turn the turning ring 13 by hand, the engagement between screw threads 24 and 25 makes bar 15 moving towards the center of chuck part 12, finally holds the bottle neck with its rubber end 31.

FIG. 6 is a vertical cross-sectional view of FIG. 2 taken along the line 6—6. When bars 15 hold the bottle neck, we can still turn the turning ring 13 bit by bit, finally stop while one of holes 16 and one of holes 23 form a joint hole. Push pin 17 into the joint hole thus chuck part 12 is fixed to the bottle.

Figure 7:
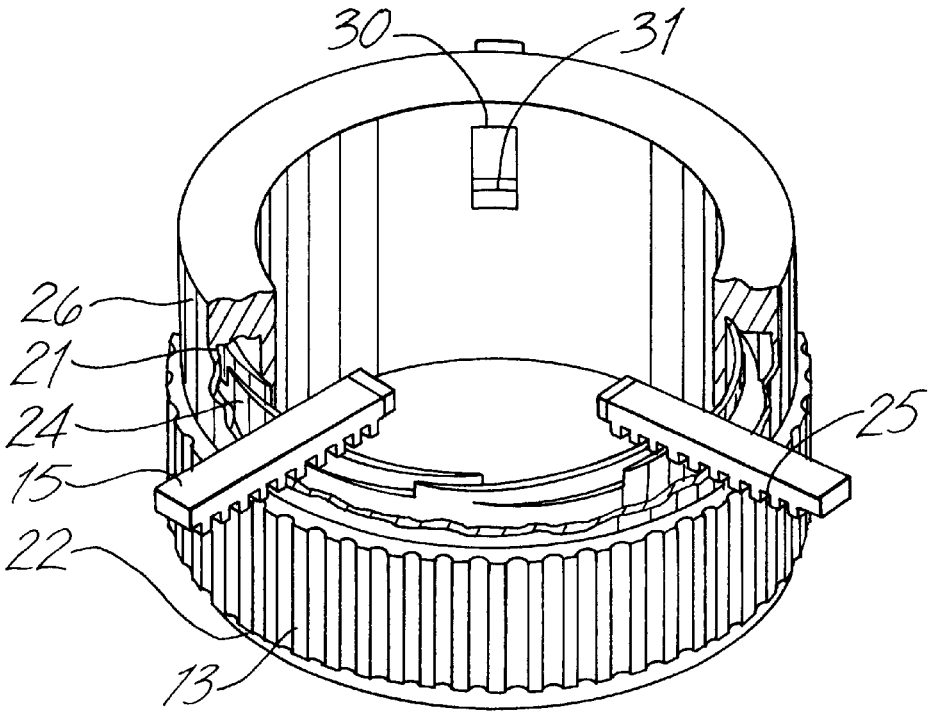
FIG. 7 is a perspective view of a turning back chuck device cut away partially shown in FIG. 2, showing engagement of the movable turning ring and the movable screw threaded bars.

FIG. 7 is a perspective view of a turning back chuck device cut away partially shown in FIG. 2, showing engagement of the movable turning ring and the movable screw threaded bars. The holes 20 and 30 have a size and shape to allow the bars 15 retained therein to move radially but not rotationally. Screw threads 24 on turning ring 13 are sized and spaced to engage screw threads 25 on bars 15.

Figure 8:
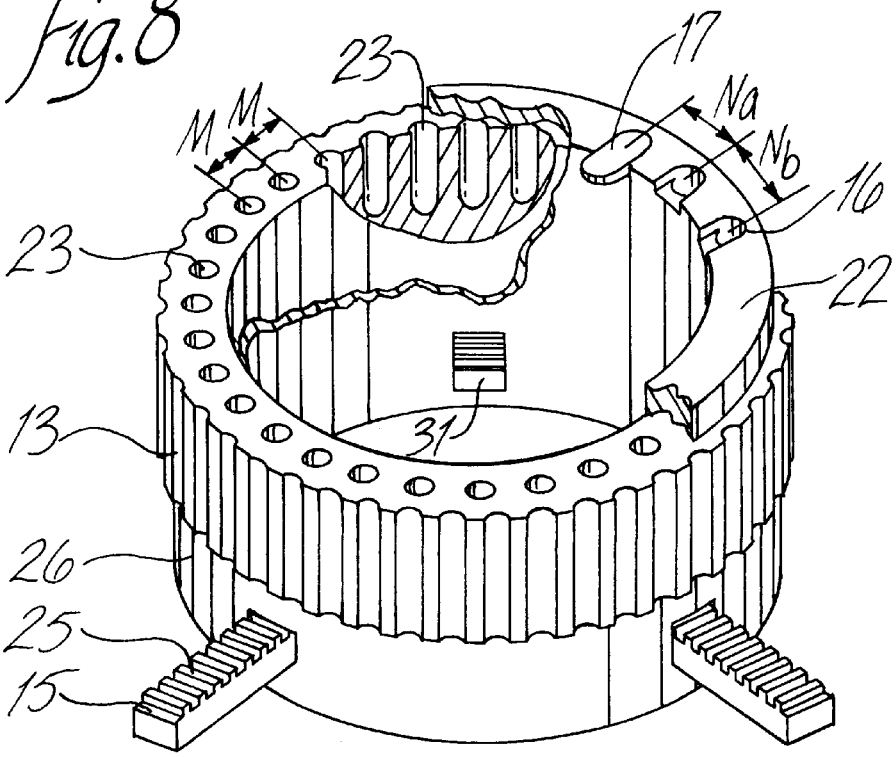
FIG. 8 is a perspective view of a chuck device cut away partially shown in FIG. 2, showing the holes separately located on the fixing ring and the movable turning ring.

FIG. 8 is a perspective view of a chuck device cut away partially shown in FIG. 2, showing the holes separately located on the fixing ring and the movable turning ring. There are a group of longitudinal holes 23 spreaded in a same distance M on the top surface of turning ring 13. There are a group of open ended holes 16 spreaded in different distances Na, Nb, Nc, . . . on wall 22 of fixing ring 26. When we turn the turning ring 13 to hold the bottle very tight, we often find that one of holes 16 and one of holes 23 can not form a joint hole for pin, 17 pushing in. We must turn back a little bit to find a joint hole, thus the bottle will be held loosely. If there is only one hole 16, the maximum turning back distance is M. If there are two holes 16 spreaded in distance Na=1.5M, the maximum turning back distance is 0.5M. If there are three holes 16, the distance between second hole and third hole Nb=1.25M, the maximum turning back distance is 0.25M. In the same way, the fourth hole Nc=1.125M makes it to 0.125M, the fifth hole Nd=1.0625M makes it to 0.0625M, . . . So if we want to hold the bottle tightly not to turn back, we not only increase the number of holes 23 to make distance M shorter, but also increase the number of holes 16 to make turning back distance shorter. In consideration of each bar 15 having rubber end 31, five holes 16 are actually enough to hold the bottle tightly not to turn back.

Figure 9:
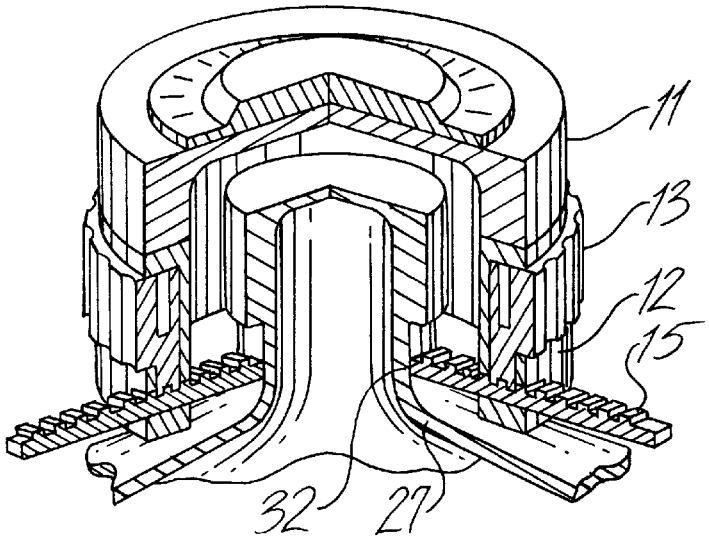
FIG. 9 is a perspective view cut away partially, showing Bottle Lock With A Chuck Device to lock a bottle.

FIG. 9 is a perspective view cut away partially, showing Bottle Lock With A Chuck Device to lock a bottle. The neck 32 of a bottle 27 is put into chuck part 12. Turning the turning ring 13 to hold neck 32 tightly by bars 15, then pushing pin 17 into a joint hole, thus chuck part 12 is fixed to bottle 27. Cap 11 with a regular lock will lock it.

Figure 10:
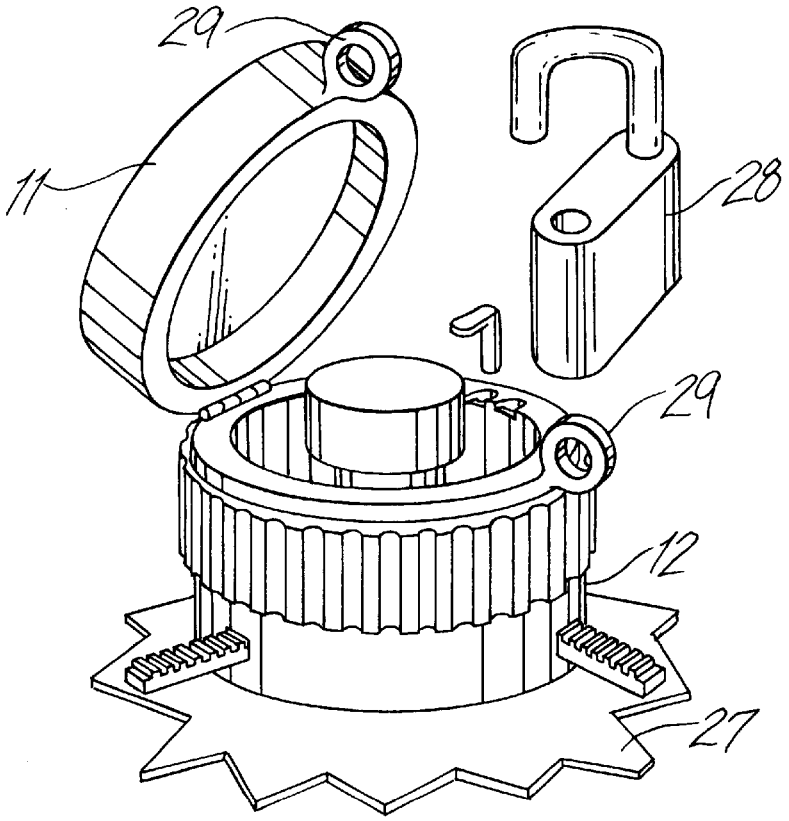
FIG. 10 is a perspective view of another Bottle Lock With A Chuck Device separated with a regular lock to lock a bottle.

FIG. 10 is a perspective view of another Bottle Lock With A Chuck Device separated with a regular lock to lock a bottle. There are two eyehole rings 29 separately fixed to chuck part 12 and cap 11 without a fixed lock. A changeable padlock 28 will cross both eyehole rings 29 to lock bottle 27.

As has been described above, according to the present invention, every bottle can be easily locked and unlocked. We can easily transfer the lock device from one bottle to another. So the problems due to lock any kind bottle are solved. My invention is very novel.

Having thus described my invention, I claim:

1. A locking device comprising:

an open ended, hollow, cylindrical holding means having an open ended, hollow, cylindrical inner fixing ring, an open ended, hollow, cylindrical outer movable turning ring, and three or more threaded bars, said fixing ring having a group of open ended holes on its top surface, said movable turning ring having a group of longitudinal ditches on its top surface and having a number of threads on its bottom surface, said movable turning ring being hooped onto said fixing ring to thereby rotate around said fixing ring, said threads of said movable turning ring being engaged with said threaded bars to move them forward or backward together;

a cylindrical cap for engagement with the top surface of said holding means; and a pin for engagement with one of said holes and one of said ditches when both said hole and said ditch form a joint longitudinal ditch.

2. The locking device according to claim 1, wherein said cap is hingedly connected to said holding means.

3. The locking device according to claim 1, where said threaded bars have rubber fixed to their inner ends.

4. The locking device according to claim 1, where each said threaded bar crosses an open ended hole on said fixing ring separately.

5. The locking device according to claim 1, wherein said turning ring has a group of longitudinal ditches spaced equally around the top surface of said movable turning ring.

6. The locking device according to claim 1, wherein said turning ring has a group of longitudinal ditches spaced equally around the top surface of said movable turning ring, and said fixing ring has a group of open ended holes spaced unequally around the top surface of said fixing ring.

7. The locking device according to claim 1, where each of said threaded bars has a spring fixed to its inner end.

8. A locking device comprising:

a ring-shaped chuck part having a fixing ring with a group of open ended holes on the top surface of said fixing ring and a movable turning ring being hooped onto said fixing ring with a group of ditches on the top surface of said turning ring and a number of threads on the bottom edge of said turning ring, said chuck part also including three or more movable bars for engagement with said threads of said turning ring to cross said fixing ring separately;

a cap connected to said chuck part, said cap movable between a first locked position in which it obstructs access to the open interior of said ring-shaped chuck part, and a second unlocked position in which the open interior of said chuck part is accessible; and a pin for inserting through one of said holes and one of said ditches when one of said holes aligns with one of said ditches to thereby prevent movement of said bars with respect to said chuck part.

* * * * *